United States Patent [19]

Atchley

[11] Patent Number: 4,561,686

[45] Date of Patent: Dec. 31, 1985

[54] END EFFECTOR

[76] Inventor: Raymond Atchley, 3470 Mandeville Canyon Rd., Los Angeles, Calif. 90049

[21] Appl. No.: 524,910

[22] Filed: Aug. 22, 1983

[51] Int. Cl.[4] ..... B66C 1/02

[52] U.S. Cl. ..... 294/64.1

[58] Field of Search ..... 294/64 R, 93, 99 R, 294/DIG. 2, 67 C, 64 A, 65; 414/735, 744 A; 248/362, 363, 206 R

[56] References Cited

U.S. PATENT DOCUMENTS

| | | | |
|---|---|---|---|
| 3,245,710 | 4/1966 | Begemann | 294/99.1 |
| 3,354,856 | 11/1967 | Annibale | 294/64.1 |
| 4,049,484 | 9/1977 | Priest et al. | 294/64 R |
| 4,294,424 | 10/1981 | Teissier | 294/64 R |

OTHER PUBLICATIONS

Monthly Report on the Use of Robots—Jul. 1981.

*Primary Examiner*—James B. Marbert
*Attorney, Agent, or Firm*—George J. Netter

[57] ABSTRACT

A flexible bag-like enclosure is carried by a movable arm so that it may be suitably located at any desired position and selectively raised and lowered as desired. A fitting is coupled to the opening of the bag-like enclosure and connected by a length of flexible hose to a source of low-pressure fluid under the control of a selectively actuable valve. The bag-like enclosure includes a substantial quantity of relatively dense, particulate material. A lower surface of the bag-like enclosure has a plurality of openings of a size substantially less than that of the individual particulate members so that they will be retained within the enclosure.

The bag-like enclosure is rested on an object to be moved such that the enclosure lower wall will conform to the surface of the object. Then the interior of the enclosure is reduced to a low fluid pressure condition which causes the lower wall of the enclosure and immediately adjacent particulate matter to become rigid and conform about the object which provides the desired gripping effect on the object.

6 Claims, 5 Drawing Figures

END EFFECTOR

The present invention relates generally to an end effector, and more particularly, to an end effector which is capable of gripping objects having a wide range of shapes and geometry with such force as to permit lifting and moving of the same.

FIELD AND BACKGROUND

There are many industrial situations in which it is desirable to effect lifting and moving of an object from one location to another and to do so without damaging or risking damage to the object during the lifting and movement.

Devices which grip and lift or move an object are frequently referred to as end effectors and are employed in many types of industries particularly where such lifting and moving must be accomplished in an environment hostile to a human being (e.g., radiation area). Where the object to be handled has a fixed geometry or shape, the end effector may be, in most cases, specially designed to accomplish the task. However, when the objects will change size and shape over a broad range, this increases the complexity of the task and in the past no known device has been found to be completely satisfactory for a wide range of shapes of objects.

SUMMARY OF THE DISCLOSED EMBODIMENT

In the practice of the described invention, there is provided a flexible bag-like enclosure carried by a movable arm so that it may be suitably located at any desired position and selectively raised and lowered as desired. A pneumatic fitting is coupled to the opening of the bag-like enclosure and connected by a length of flexible hose to a source of low-pressure gas (e.g., air) under the control of a selectively actuatable valve. The bag-like enclosure includes a substantial quantity of relatively dense particulate material which will maintain its discrete particulate nature throughout use. A lower surface of the bag-like enclosure includes a plurality of openings of a size substantially less than that of the individual particulate members so that they will be retained within the enclosure.

In use, with normal ambient internal gas pressure, the control arm lowers the bag-like enclosure directly down and onto an object to be lifted or otherwise handled such that the lower wall of the flexible enclosure will conform to the surface of the object as a result of the particulate matter acting under the influence of gravity. Then the valve is actuated to reduce the interior of the enclosure to a low gas pressure condition which causes the lower wall of the enclosure and immediately adjacent particulate matter to become rigid and conform about the object providing the desired gripping effect on the object. Next, while maintaining the low pressure condition, the control arm is raised and lowered or moved as desired in order to position the object to the new location. Finally, the valve is closed which returns the enclosure interior to normal ambient gas pressure and the object is released. On release, a pulse of pressurized gas is passed through the enclosure to remove any dust, dirt or other foreign matter which may have been drawn therein during the low gas pressure phase.

DESCRIPTION OF A PREFERRED EMBODIMENT

Figure 1:
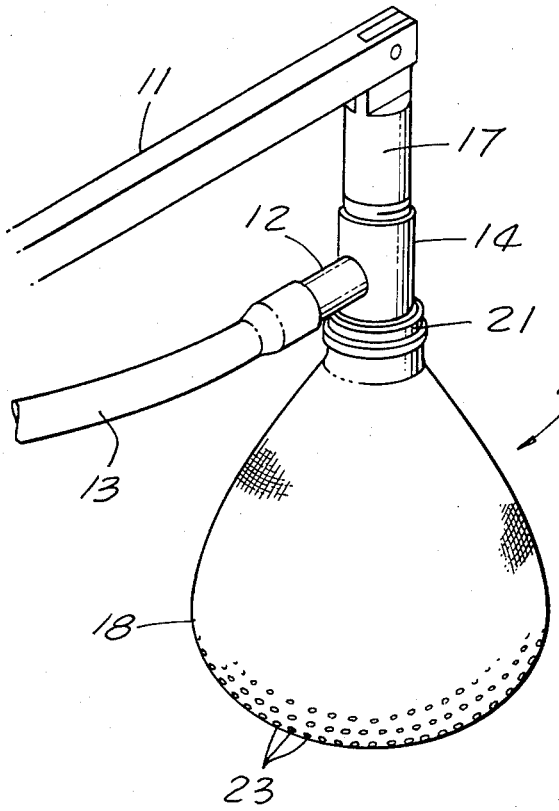
FIG. 1 is a perspective, partially fragmentary view of the described end effector shown on a lifting and moving arm.

With reference now to the drawings and particularly FIG. 1, the end effector described herein is enumerated generally as at 10 and is seen to be pivotally interconnected to the end of positioning arm 11 which, in a way well known in the art, can be raised, lowered or moved laterally to any desired position for locating the end effector during use. For purposes that will be more particularly described, a fitting 12 on the end effector 10 interconnects via a length of flexible hose 13 with a suitable gas pump (not shown) for reducing the pressure within the end effector and for supplying a pulse of pressurized gas. Although many gases may be found suitable for present purposes, it is contemplated that air will be the most generally satisfactory.

Figure 2:
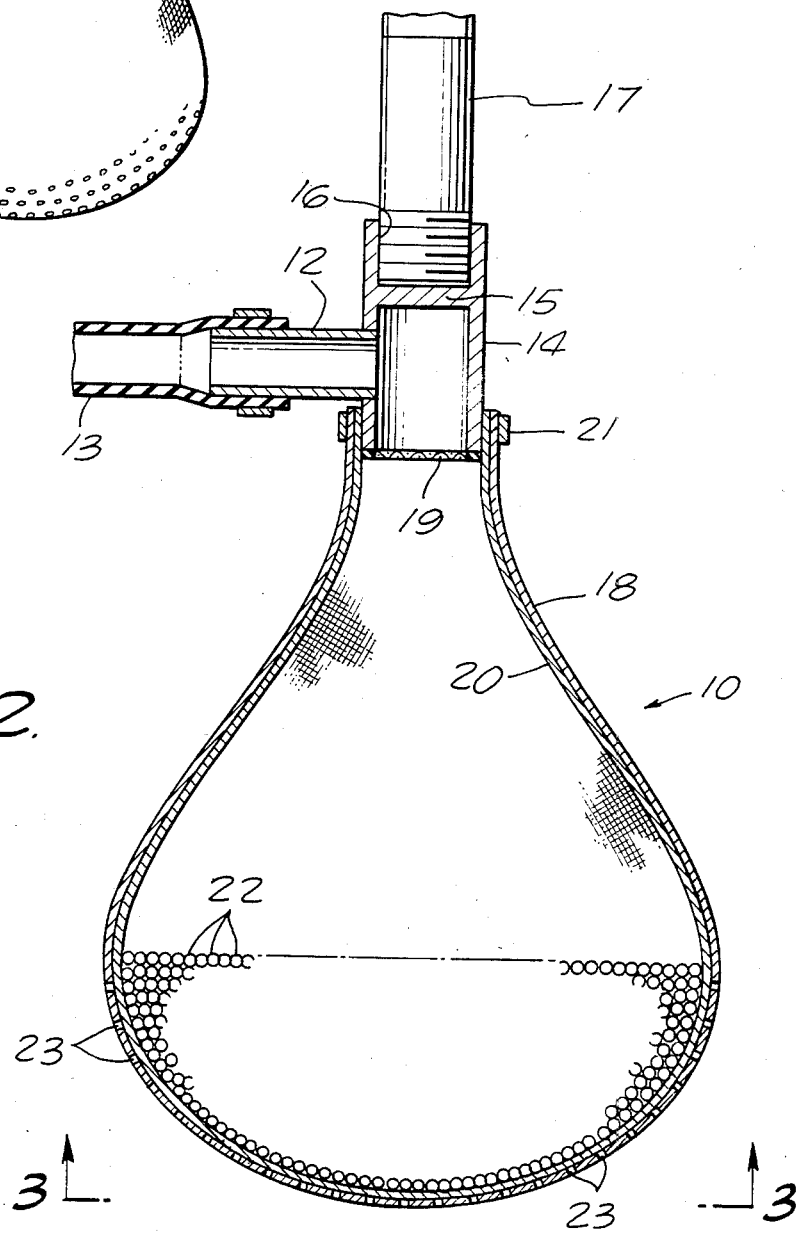
FIG. 2 is a side elevationl, sectional view of the device of FIG. 1.
Figure 3:
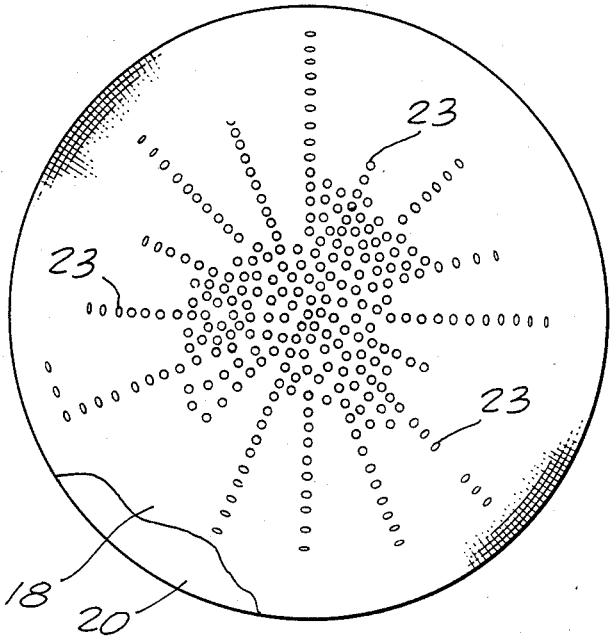
FIG. 3 is a bottom plan view taken along the line 3—3 of FIG. 2.

Turning now additionally to FIG. 2, the penumatic fitting 12 is seen to be substantially a short section of pipe which is received in the side wall of a further pipe section 14 to form a "T". The uper end of the "T" is closed off by a wall 15 above which there is a recessed threaded opening 16 for receiving a cylindrical link 17. The uper end of link 17 pivotally interconnects with a yoke-like end of the positioning arm 11.

The lower end of pipe section 14 has its internal bore in open communication with the fitting 12 is received within the open mouth of a large sack-like enclosure 18 with its inner end covered by a relatively fine mesh screen or plate 19. The enclosure 18 also has an internal bag 20 of substantially identical dimensions and geometry constructed of fabric (e.g., nylon) through which a fluid such as air or water can pass. This inner bag 20 prevents the loss of particulate matter when the outer bag 18 becomes worn, ripped, or torn as it comes into repeated contact with objects to be picked up and moved. Secure sealing relation between the enclosure and the open end of 14 is provided by a ring clamp 21 received about the side walls of the sack-like enclosure immediately adjacent its opening. The enclosure 18 is constructed of a highly flexible material which readily conforms to the surface configuration of an object pressed against it. Suitable materials for constructing this enclosure 18 are thin rubber and various kinds of plastic sheeting.

A quantity of relatively dense, small particulate matter 22 which will maintain their discrete shapes and not readily be abraded into smaller form such as metal shot, for example, are located within the enclosure 18 and bag 20 filling approximately one-third to one-half of the enclosure volume. The lower surface of the flexible enclosure 18, substantially below where the particulate matter 22 would normally contact the enclosure inner wall, there are provided a plurality of openings 23 of a size substantially less than the minimum cross-sectional dimension of the particulate matter. That is, the openings are of such size as to permit the ready flowing of air therethrough while at the same time retain the particulate matter within the enclosure.

Figure 4:
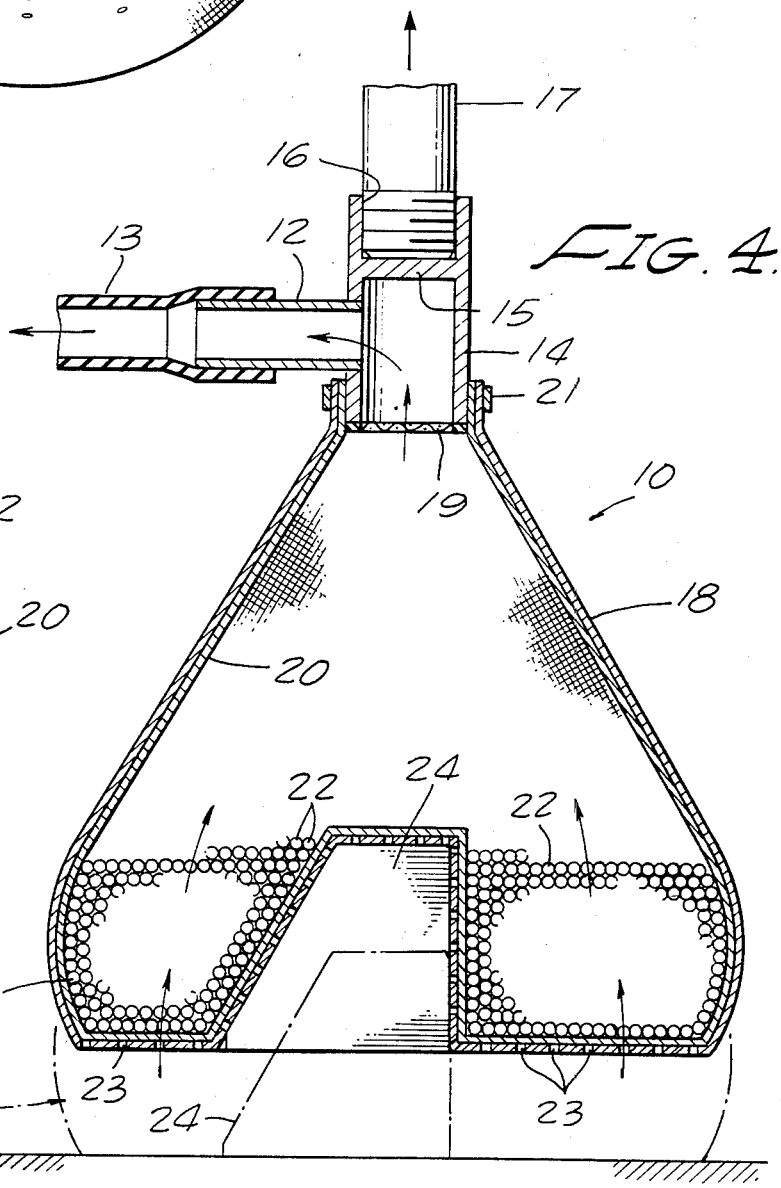
FIG. 4 is a side elevational, sectional view similar to FIG. 2 showing the device in use gripping an object for lifting and moving.
Figure 5:
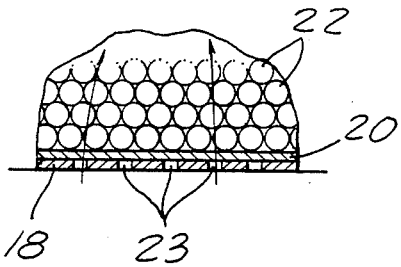
FIG. 5 is a fragmentary, sectional, elevational view taken through the lower wall of the described end effector.

In use, the arm 11 is manipulated in a known manner to position the end effector 10 so that the flexible enclosure 18 rests on an object 24 which it is desired to lift or relocate. Since the enclosure outer wall is a highly flexible material, this permits the weight of the particulate matter 22 to push the flexible wall into close conformity to the outer surface of the object 24 as shown in FIG. 4. After this has been achieved, the valve to the vacuum pump is actuated causing gas to be removed from the interior of the enclosure and pulling streams of gas through the openings in the lower wall of the enclosure (FIG. 5). The reduction in internal gas pressure of the enclosure 18 and bag 20 produces two effects: first of all, it causes the particulate matter 22 within the enclosure to subtantially solidify forming gripping "fingers" conforming to the surface of the object to be relocated; secondly, gas moving through the lower surface of the enclosure and thence outwardly through the flexible hose produces an added gripping force on the object due to the external gas pressure. Both of these actions tend to produce the desired source gripping force on the object. Arm 11 may now move the object to the new location. After repositioning of the object, the valve to the vacuum pump is closed which allows the enclosure internal pressure to return to ambient pressure and the object is released.

After release of the object, a pulse of pressurized gas is passed through the enclosure and outwardly of the openings 23 to remove any dust, dirt or other foreign particulate matter that may have made its way into the enclosure during the low-pressure phase of operation.

Although described as using gas (e.g., air), it is contemplated that the end effector could be operated within an external liquid environment (e.g., water) and be just as advantageously employed. Accordingly, the term "fluid" herein will refer to both gas and liquid.

The mesh screen or plate 19 prevents the particulate matter 22 from making its way into the hose 13 and possibly farther.

I claim:

1. A device for gripping an object to lift or otherwise move the object comprising:

flexible sack-like enclosure means having a single relatively large opening and said enclosure means being fluid impermeable except for a plurality of relatively small openings arranged over a given gripping area;

a fluid permeable baglike means received within the enclosure means;

a quantity of particulate matter received within the baglike means;

selectively positionable means interconnected with the enclosure means and baglike means for moving said enclosure and baglike means in a predetermined manner; and means interconnecting the enclosure means large opening with a source of low fluid pressure so that the enclosure means mechanically grips the object.

2. A device as in claim 1, in which the enclosure means includes a flexible rubber sheet.

3. A device as in claim 1, in which the particulate matter includes generally spherical metal shot.

4. A device as in claim 1, in which the means interconnecting the enclosure means with a source of low fluid pressure includes selectively actuatable valve means.

5. A device as in claim 1, in which the small openings do not exceed about 0.060 inches.

6. A device as in claim 1, in which the enclosure means hangs generally vertically downwardly from said selectively positionable means, and the small openings are located on the bottom of the enclosure means with the particulate matter covering the small openings as a result of gravity.

* * * * *